United States Patent [19]

Buckley et al.

[11] 4,007,042

[45] Feb. 8, 1977

[54] MIGRATION IMAGING METHOD

[75] Inventors: David A. Buckley; Roger N. Ciccarelli, both of Rochester; Frank G. Belli, Webster, all of N.Y.

[73] Assignee: Xerox Corporation, Stamford, Conn.

[22] Filed: Apr. 3, 1975

[21] Appl. No.: 564,951

Related U.S. Application Data

[60] Division of Ser. No. 6,862, Jan. 29, 1970, which is a continuation-in-part of Ser. No. 566,791, July 21, 1966, abandoned.

[52] U.S. Cl. ..... 96/1 PS; 96/1.5; 250/315 R; 346/153; 346/160; 427/145; 427/161

[51] Int. Cl.[2] ..... G03G 13/22

[58] Field of Search ..... 96/1 R, 1 PS, 1 M; 250/315 R, 315 A; 346/74 P, 74 ES; 427/145, 161

[56] References Cited

UNITED STATES PATENTS

| | | | |
|---|---|---|---|
| 3,801,314 | 4/1974 | Goffe | 96/1 PS |
| 3,909,262 | 9/1975 | Goffe et al. | 96/1 PS X |

*Primary Examiner*—Roland E. Martin, Jr.

[57] ABSTRACT

A migration imaging system including imaging members comprising a substrate overcoated with a softenable layer, and migration marking material, with the softenable layer having a thin surface skin of material having a higher viscosity than the remainder of the softenable material layer.

17 Claims, 3 Drawing Figures

MIGRATION IMAGING METHOD

CROSS REFERENCE TO RELATED CASES

This is a divisional, of application Ser. No. 6,862, filed Jan. 29, 1970. Ser. No. 6,862, filed Jan. 29, 1970, is a continuation-in-part of copending application Ser. No. 566,791, filed July 21, 1966 now abandoned.

BACKGROUND OF THE INVENTION

This invention relates in general to imaging systems, and more specifically, concerns a novel migration imaging system.

There has recently been developed a migration imaging system capable of producing images of high quality and excellent resolution. This system is described in detail and claimed in copending applications Ser. No. 460,377, filed June 1, 1965; now U.S. Pat. No. 3,520,681 Ser. No. 837,591, filed June 30, 1969; and Ser. No. 837,780, filed June 30, 1969. In a typical embodiment of this imaging system, an imaging member is prepared by coating a layer of a softenable material, for example a soluble insulating resin, onto a supporting substrate and overcoating the softenable layer with a fracturable layer of migration marking material which in this particular embodiment comprises a layer of electrically photosensitive material. This imaging member is electrically latently imaged, for example, by electrostatically charging the surface of the member with a corona discharge device, and exposing the member to an image pattern of activating electromagnetic radiation, here light. The latently imaged member is then developed by softening the softenable layer, for example by applying a solvent for the softenable material, which in addition to softening the layer may also dissolve it. Portions of the fracturable layer of migration marking material which have been exposed migrate through the softenable layer as it softens or dissolves leaving an image pattern of migration marking material on the substrate conforming to a negative of a positive original image. Those portions of the fracturable layer which do not migrate toward the substrate (here those portions which were not exposed to light) and substantially all of the softenable layer are washed away by the solvent. The image left on the substrate is of high quality and good resolution. Various alternative embodiments are further described in the above cited copending applications.

"Softenable" as used herein is intended to mean any material which can be rendered more permeable thereby enabling particles to migrate through its bulk. Conventionally, changing permeability is accomplished by heat or solvent softening. "Fracturable" layer or material as used herein, means any layer or material which is capable of breaking up during development, thereby permitting portions of said layer to migrate towards the substrate or to be otherwise removed.

Another recently developed migration imaging system utilizes photosensitively inert particles in an imaging structure such as that described above. This system is described in detail in copending application Ser. No. 483,675, filed Aug. 30, 1965. In this system the imaging member is latently imaged directly, for example, by corona charging through a stencil or mask. When the softenable material layer is developed and dissolved by dipping the plate in the solvent for said softenable layer, migration marking particles migrate toward the substrate in imagewise configuration. Undesired and unmigrated marking particles are typically washed away along with substantially all of the softenable layer. While the imaging process does not require photosensitive or photoconductive materials (although they may be used herein with equally acceptable results) the charge pattern must typically be originally applied in image configuration, e.g., by corona charging through a stencil. The image produced by this process has a similar appearance to those produced by the migration imaging system already described above.

In new and growing areas of technology such as the migration imaging system of the present invention, new methods, apparatus, compositions, and articles of manufacture are often discovered for the application of the new technology in a new mode. The present invention relates to a novel migration imaging system having novel migration imaging members including surface skin layers at the surface of the softenable material.

SUMMARY OF THE INVENTION

It is, therefore, an object of this invention to provide a novel imaging system.

It is another object of this invention to provide an improved method of preparing imaging members for use in migration imaging systems.

It is another object of this invention to provide novel imaging members.

It is another object of this invention to provide methods for preparing more uniform imaging members.

It is another object of this invention to provide a method of improving the sensitivity of migration imaging systems.

It is yet another object of this invention to provide migration imaging systems capable of producing images of high contrast density, uniform image density, and low background.

It is still another object of this invention to provide migration imaging systems capable of producing images of high resolution.

The foregoing objects and others are accomplished in accordance with the migration imaging system of the present invention by providing an imaging member comprising a substrate overcoated with a softenable layer and migration marking material, with the softenable layer having a thin surface skin of material having a higher viscosity than the remainder of the softenable material layer.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
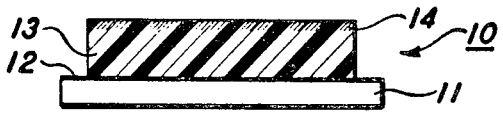
FIG. 1 shows a partially-schematic cross-sectional view of a preferred embodiment of the imaging member of the advantageous system of the present invention.

In FIG. 1, a preferred embodiment of the advantageous imaging members of the present invention is illustrated in a partially schematic, cross-sectional view wherein the imaging member 10 comprises substrate 11, with layer of softenable material 13 coated thereon. The migration marking material which typically forms the images in migration imaging systems such as the one described in the present invention, is generally on or in softenable layer 13. (The migration marking material is not illustrated here so that the surface skin layer 14 may be more clearly illustrated.) For example, in a typical embodiment, as described in great detail in copending application Ser. No. 837,591, filed June 30, 1969, the migration marking material is arranged in a fracturable layer contiguous the surface of the softenable layer 13 spaced apart from substrate 11. Fracturable layer as used herein refers to any layer of migration marking material, for example, migration layer forms such as service continuous Swiss cheese pattern layers, layers comprising discrete particles, and those comprising apparently more mechanically continuous layers with a microscopic network of lines of mechanical weakness of discontinuity, or layers which are otherwise fracturable and not completely mechanically coherent. Such fracturable layers contiguous the surface of the softenable layer 13 may in various embodiments be coated onto the surface of the softenable layer, or, slightly, partially, or substantially embedded in the softenable material at the surface of layer 13. The thickness of such fracturable layers is preferably in the range between about 0.01 and about 2.0 microns, although fracturable layers of thicknesses of about 5 microns have been found to give good results for some materials. When the fracturable layer 13 comprises discrete particles, a preferred average particle size is in the range of not greater than about 2.0 microns. Images of optimum density are produced with systems having particles of average size not greater than about 0.7 microns.

In other embodiments described in great detail in copending application Ser. No. 837,591, filed June 30, 1969, the migration material is dispersed throughout the softenable layer 13 in a binder structure configuration. The particles of migration marking material dispersed in this binder structure are preferably of average size not greater than about 2 microns. Submicron particles give even more satisfactory results. An optimum range of particle size comprises particles of average size not greater than about 0.7 microns. These smaller particles give migration images which have better resolution and image densities than the larger particles, although larger particles, even those greater in size than about 2 microns, may produce satisfactory images in the binder structure system.

The migration marking material used in the advantageous imaging members of the present invention may comprise any suitable material. In various embodiments, the marking material may be electrically photosensitive, photoconductive, photosensitively inert, electrically conductive, electrically insulating, magnetic, colored, transparent, or have any other property depending upon its intended use in the particular embodiment.

Photosensitive as used herein more particularly means "electrically photosensitive". While photoconductive materials (and "photoconductive" is used in its broadest sense to mean materials which show increased electrical conductivity when illuminated with electromagnetic radiation and not necessarily those which have been found to be useful in xerography in a xerographic plate configuration) have been found to be a class of materials useful as "electrically photosensitive" materials in this invention and while the photoconductive effect is often sufficient in the present invention to provide an "electrically photosensitive" material, it does not appear to be a necessary effect. Apparently the necessary effect according to the invention is the selective relocation of charge into, within and out of the marking material said relocation being effected by light action on the bulk or the surface of the "electrically photosensitive" material, by exposing said material to activating radiation; which may specifically include photoconductive effects, photoinjection, photoemission, photochemical effects and others which cause said selective relocation of charge. Typical photosensitive materials suitable for use as migration marking materials include inorganic or organic photoconductive insulating materials; materials which undergo conductivity changes when photoheated, for example, see Cassiers, Photog, Sci. Engr. 4. No. 4, 199 (1960); materials which photoinject, or inject when photoheated; amorphous selenium; amorphous selenium alloyed with arsenic, tellurium, antimony or bismuth, etc.; amorphous selenium or its alloys doped with halogens; and mixtures of amorphous selenium and the crystalline forms of selenium including the monoclinic and hexagonal forms. Other suitable inorganic materials include sulphur, cadmium sulfide, zinc oxide, zinc sulfide, cadmium sulfoselenide, cadmium selenide, cadmium yellows such as Lemon Cadmium Yellow X-2273 from Imperial Color and Chemical Dept. of Hercules Powder Co., lead iodide, lead chromate, lead oxide and many others. Middleton et al U.S. Pat. No. 3,121,006 lists typical inorganic photoconductive pigments. Suitable organic materials include dioxazines, azo dyes such as Watchung Red B, a barium salt of 1-(4′-methyl-5′-chloro-azobenzene-2′-sulfonic acid)-2-hydrohydroxy-3-napthoic acid, C.I. No. 15865, a quinacridone, Monastral Red B, both available from DuPont; Indofast double scarlet toner, a Pyranthrone-type pigment available from Harmon Colors; quindomagenta RV-6803, a quinacridone-type pigment available from Harmon colors; Cyan Blue, GTNF, the beta form of copper phthalocyanine, C.I. No. 74160, available from Collway Colors; Monolite Fast Blue GS, the alpha form of metal-free phthalocyanine, C.I. No. 74100, available from Arnold Hoffman Co.; commercial indigo available from National Aniline Division of Allied Chemical Corp.; yellow pigments prepared as disclosed in copending applications Ser. No. 421,281, filed Dec. 28, 1964, now U.S. Pat. No. 3,447,922 or as disclosed in Ser. No. 445,235, filed Apr. 2, 1965, now U.S. Pat. No. 3,402,177 X-form metal-free phthalocyanine prepared as disclosed in copending application Ser. No. 505,723, filed Oct. 29, 1965, now U.S. Pat. No. 3,357,989 quinacridonequinone from DuPont, sensitized polyvinyl carbazole, Diane Blue, 3,3′-methoxy-4,4′-diphenyl-bis (1″ azo-2″ hydroxy-3″-naphthanilide), C.I. No. 21180, available from Harmon Colors; and Algol G. C., 1,2,5,6-di (D,D′-diphenyl)-thiazole-anthraquinone, C.I. No. 67300, available from General Dyestuffs and mixtures thereof. This list of materials is representative rather than limiting. In certain applications, it may be desirable to sensitize these photosensitive materials with spectral and electrical sensitizers.

Other materials which may be included in photosensitive migration material include organic donor-acceptor (Lewis acid-Lewis base) charge transfer complexes made up of donors such as phenolaldehyde resins, phenoxies, epoxies, polycarbonates, urethanes, styrene or the like complexed with electron acceptors such as 2,4,7-trinitro-9-fluorenone; 2,4,5,7-tetranitro-9-fluorenone; picric acid; 1,3,5-trinitro benzene; chloranil; 2,5-dichlorobenzoquinone; anthraquinone-2-carboxylic acid, 4-nitrophenol; maleic anhydride; metal halides of the metals and metalloids of groups I–B and II–VIII of the periodic table including, for example, aluminum chloride, zinc chloride, ferric chloride, magnesium chloride, calcium iodide, strontium bromide, chromic bromide, arsenic triiodide, magnesium bromide, stannous chloride etc.; boron halides, such as boron trifluorides; ketones such as benzophenone and anisil, mineral acids such as sulfuric acid; organic carboxylic acids such as acetic acid and maleic acid, succinic acid, citroconic acid, sulfonic acid, such as 4-toluene sulfonic acid and mixtures thereof.

Typical suitable materials which are substantially photosensitively inert include graphite, dyes, starch, garnet, iron oxide, powdered iron, carbon black, tungsten, titanium dioxide and various other pigments, and mixtures thereof as well as other materials. In some embodiments, mixtures of various migration marking materials having different properties may produce particularly advantageous results. In most embodiments the marking material will be highly colored to produce a highly visible image.

In various embodiments of the imaging members of the advantageous system of the present invention, the supporting substrate 11 may be electrically conductive, or electrically insulating, or transparent, translucent, or opaque, and have any other desired physical characteristic. It should be noted that in some embodiments, the softenable layer 13 may have sufficient self-support and integrity to be prepared without a supporting substrate, and brought in contact with a desired substrate during the imaging process. In another embodiment, substrate 11 may comprise an electrically insulating material having an electrically conductive coating 12 upon the surface thereof. In various embodiments, the supporting substrate 11, and, indeed, the entire imaging member of the present invention, may take any suitable form including a web, foil, laminate or the like, strip, sheet, coil, cylinder, drum, endless belt, endless moebius strip, circular disk or other shape.

As stated above, substrate 11 may comprise any suitable supporting material. Typical conductive materials suitable for use as supporting substrates include aluminum, brass, stainless steel, copper, nickel, zinc, mixtures thereof, and others.

Typical insulating materials suitable for substrates include paper, glass, film forming materials such as Plastics, for example, Mylar polyester films available from duPont, or any other suitable insulating substrate. In addition, conductively coated glass such as tin oxide or indium oxide coated glass, similar coatings on plastic substates, such as aluminized Mylar, or paper rendered conductive by the inclusion of suitable ingredients therein or through conditioning in a humid atmosphere to insure the presence of sufficient moisture to render the material conductive, may be suitable for use as substrates in various embodiments of the imaging members of the present invention.

Softenable layer 13 is illustrated in FIG. 1 with the advantageous surface skin layer 14 formed at the free surface of the softenable material. Softenable layer 13 may comprise any material which may be softened by the application of heat, solvent vapors, liquid solvents, combinations thereof, or any other suitable means for softening said material. Softenable materials are typically sufficiently electrically insulating so that charged marking material particles may migrate at least in depth in the softenable material before being discharged; however, in other embodiments the softenable layer material may be more or less electrically conductive. Typical softenable materials include polyolefins such as polyethylene and polypropylene; vinyl and vinylidene polymers such as polystyrene, acrylic polymers, polyacrilonitrile, polyvinyl esters, and polyvinyl ethers; fluorocarbons such as polyvinylfluoride and polyvinylidene fluoride; polyamides such as polycaprolactam; polyesters such as polyethylene terephthalate; polyurethanes; polypeptides such as casein; ether and acetyl polymers such as polyglycol; polysulfides; polyphenylene oxides; polysulphones; polycarbonates; cellulosic polymers such as viscose and cellulose acetate; phenolic resins; amino resins; epoxy resins; silicone resins; alkyd resins; alkyl resins, furan resins; and mixtures and copolymers thereof.

In other embodiments of the invention, the softenable layer may be itself photosensitive. Where such photosensitivity is desired in this layer, any suitable homogeneous photoconductor may be used or a photoconductor may be dispersed in a resin binder. Typical photoconductive materials include polyvinyl carbazole sensitized with trinitro fluorenone; various charge transfer complexes of aromatic resins and Lewis acids; triphenyl amine; 2,4-bis(4,4′-diethyl-aminophenyl)-1,3,4-oxidiazole; triphenylpyrrol; 1,5-cyano-naphthalene; 2-mercapto-benzothiazole; 2-phenyl-4-p-methoxybenzylidene-oxazolone; 3-benzylidene-aminocarbazole; 3-(4′-dimethylamino phenyl)-5-(4′-methoxyphenyl)-6-phenyl-1,2,4-triazine; 2-(4′-dimethylamino)-benzoxazole; 3-aminocarbazole; and mixtures thereof. These materials may be sensitized by any suitable electrical or spectral sensitizing agents. Typical sensitizing materials include Lewis acids; Lewis bases; spectral sensitizing agents such as polymethane dyestuffs; e.g., 3,3′-diethyl-thiocarbocyanine iodide, azo dyestuffs, e.g., Eirochrome Blue-Black R (C. I. No. 15705), azo-methane dyestuffs, e.g., bis(p-dimethyl aminobenzol)-azine, carbonyl dyestuffs, e.g., Solvay Ultra-Blue B (C.I. No. 62055), polycyclic dyestuffs, e.g., nitro-pyrene, heterocyclic materials, e.g., N, N′-pentamethylene-bis(benzothiazole perchlorate), phthalocyanine dyestuffs, e.g., Segnale Light Turquoise NB (C.I. No. 74160), and mixtures thereof.

The advantageous system of the present invention performs most satisfactorily with imaging members having softenable layers 13 of thicknesses in the range between about ½ and about 16 microns.

The advantageous surface skin layer 14 may either be formed as a substantially continuous layer at the surface of softenable layer 13, or as a discontinuous layer, such as distinct, separate skin portions on the softenable layer arranged, for example, as closely spaced dots. Any suitable method may be used to form the surface skin layer 14. Where the imaging member includes a fracturable layer of migration marking material, the surface skin layer 14 may be formed either before or after the fracturable layer is applied at the upper surface of the softenable material layer 13. The surface skin layer 14 may typically be formed either by coating a layer of skin material over the softenable layer 13, or by changing the properties of the surface of the softenable layer in situ.

The migration imaging system of the present invention is improved to the greatest degree by the use of surface skin layers having optimum thicknesses of not greater than about 0.2 microns. However, surface skin layers anywhere in the preferred range of thickness of not greater than about 0.3 microns perform quite satisfactorily in the inventive system.

Typical methods for forming the surface skin layer 14 include exposure to actinic light, x-rays, beta rays, gamma rays, electrical bombardment, corona charging, high voltage discharge, exposure to visible light, exposure to air, contact with chemical means such as oxidizing agents and/or cross-linking agents, over-coating with a higher viscosity material which migrates to the surface of the softenable layer as the softenable layer cures, or any other chemical, physical, or radiative means capable of forming the surface skin layer having a viscosity greater than the viscosity of the bulk of the softenable layer 13.

Where it is desired to form the surface skin layer 14 in situ from the surface portion of the softenable layer, best results are obtained by forming the surface skin by exposing the surface of the softenable material layer 13 to ultraviolet radiation. Upon exposure to ultraviolet radiation, it is believed that cross-linking and/or oxidation occurs at the surface of the softenable material, thereby forming a surface skin layer having a viscosity and/or softening temperature greater than that of the bulk of the softenable layer 13.

Figure 2:
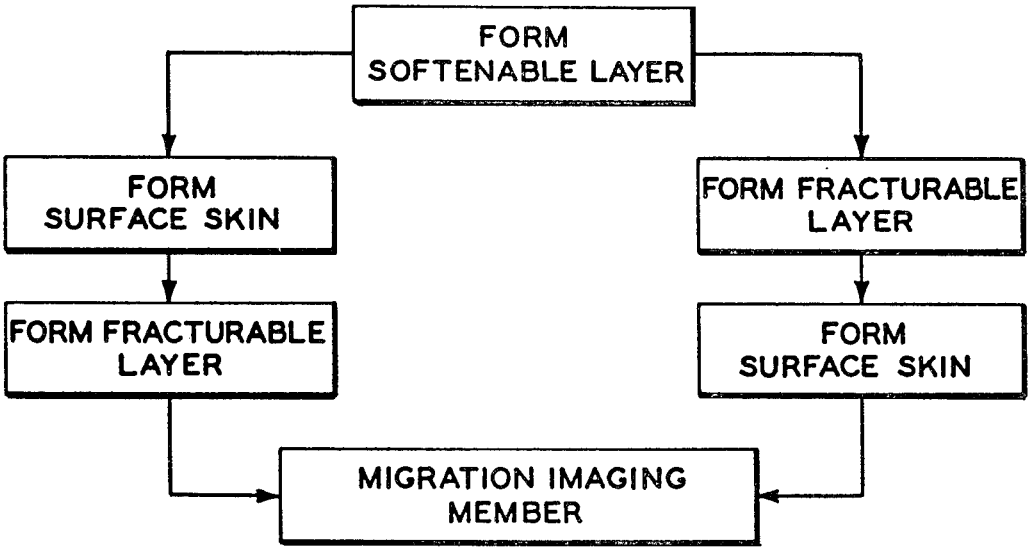
FIG. 2 shows a flow sheet describing the process for forming one embodiment of the advantageous imaging members of the present invention.

As indicated in the flow sheet of FIG. 2 wherein the process for forming one embodiment of the imaging members of the present invention is described, the imaging member is prepared by first coating the layer of softenable material onto a suitable substrate. Various means for coating layers of softenable material on substrates are disclosed in the aforementioned copending applications. Where the imaging member includes a fracturable layer of migration marking material, either one of the dual process paths illustrated in FIG. 1 may result in the desired migration imaging member having the novel surface skin layer. For example, the surface skin of higher viscosity material may be formed on the surface of the softenable layer either by modification of the surface of the softenable layer or by coating the layer of another material thereon as described above, before the fracturable layer of migration marking material is added to the migration imaging member being constructed. Alternately, the fracturable layer of marking material may be applied to the softenable layer before the surface skin layer is produced upon the advantageous imaging member. In embodiments where the binder structure imaging member is used, the particles of the migration marking material will typically be dispersed throughout the softenable layer before the surface skin layer is formed.

Where the surface skin layer has been formed on the layer of softenable material before the application of the fracturable layer of migration marking material, the fracturable layer may be applied by any suitable method. Typical methods of forming the fracturable layer include coating a dispersion of particles in a volatile carrier onto the surface of the softenable layer and allowing the volatile carrier to evaporate; vacuum evaporating a fracturable layer of a weakly cohesive marking material onto the surface of the softenable layer; mixing the marking particles with a carrier and coating the surface of the softenable layer by cascading this mixture across the surface of the softenable layer as described, for example, in Walkup U.S. Pat. No. 2,618,551; coating the fracturable layer onto the surface of the softenable layer by conventional coating techniques such as spraying, dipping, doctor blade coating, draw down bar coating, etc.; or any desired combination of these methods and/or others.

Where the fracturable layer of migration marking material is applied after the surface skin layer is formed on the softenable layer, vacuum deposition of the fracturable layer is enhanced by the more uniform and smooth surface of the surface skin layer thereby facilitating more uniform coverage during the deposition.

Figure 3:
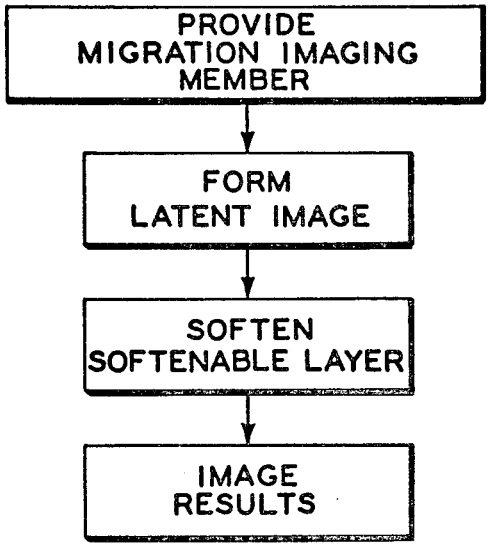
FIG. 3 shows a flow sheet describing the process of forming an image on the imaging members of this invention.

After the advantageous migration imaging members are preparing by the methods described above in conjunction with FIG. 2, said members may be imaged by the processes described in the aforementioned copending applications and by the process generally described in conjunction with FIG. 3. These process steps generally comprise providing the migration imaging member, applying an imagewise migration force to the migration marking material, said migration force often being an electrical latent image of some sort, and developing the latently imaged member by softening the softenable material layer to allow an imagewise migration of the migration marking material in depth in the softenable layer toward the substrate.

The imagewise migration force which causes the migration marking material to migrate in depth in softenable material may be any suitable force. For example, centrifugal force, gravitational force, electrical field force, magnetic field force and other forces may be used in the advantageous process of the present invention. In many specific embodiments of such migration imaging systems, electrical forces and electrical field forces have been found to be preferred.

Any method for forming an electrical latent image upon the imaging member may typically be used in the advantageous process of the present invention. For example, the surface of the imaging member may be electrically charged in imagewise configuration by various modes including charging or sensitizing in image configuration through the use of a mask or stencil, or by first forming such a charge pattern on a separate layer such as a photoconductive insulating layer used in conventional xerographic reproduction techniques, and then transferring this charge pattern to the surface of a migration imaging plate by bringing the two into very close proximity and utilizing breakdown techniques as described, for example, in Carlson U.S. Pat. No. 2,982,647, and Walkup U.S. Pat. Nos. 2,825,814 and 2,937,943. In addition, charge patterns conforming to selected shaped electrodes or combinations of electrodes may be formed on a support surface by the "TESI" discharge technique, as more fully described in Schwertz U.S. Pat. Nos. 3,023,731 and 2,919,967, or by techniques described in Walkup U.S. Pat. Nos. 3,001,848 and 3,001,849, or by induction imaging techniques, or even by electron beam recording techniques, as described in Glenn U.S. Pat. No. 3,113,179.

Where the migration marking material or the softenable material is electrically photosensitive material, an electrical latent image may be formed on the imaging member by electrostatically charging the member and then exposing the charged member to activating electromagnetic radiation in an imagewise pattern, for example a light-and-shadow image pattern.

Typical methods of charging such members include: corona discharge described in Carlson U.S. Pat. No. 2,588,699; triboelectric contact charging as described in Carlson U.S. Pat. No. 2,297,691; induction charging from a contacting insulator maintained at a high potential; or combinations thereof. Where the substrate is conductive, the charging step is enhanced by grounding the conductive substrate. Similarily, where the substrate is electrically insulating, the electrically insulating substrate may be placed on a grounded conductive backing to enhance the charging step. Still another method of electrically charging such a member is to electrostatically charge both sides of the member to surface potentials of opposite polarity.

A member having an electrical latent image thereon is then developed by softening the softenable layer by the application of a suitable softening medium, such as a liquid solvent, heat, solvent vapors, or combinations thereof, or any other means for softening the softenable layer. Upon softening of the softenable layers, the migration marking material is allowed to migrate in depth in the softenable layer toward the substrate in imagewise configuration. Typical development methods include: dipping the latent image-bearing plate in a solvent for the soluble layer whereby the softenable layer and unmigrated marking material is washed away, leaving an image comprising migrated marking particles adhering to the substrate in image configuration; softening the plate by heat, solvent vapors or solvent whereby portions of the marking material migrate toward the substrate in image configuration; contacting the plate surface with a solvent spray or vapor whereby the softenable layer and undesired portions of the overlayer which do not form the image are washed away leaving portions of the marking material on the substrate in image configuration. Suitable development methods include those described in copending applications, Ser. No. 460,377, filed June 1, 1965 now U.S. Pat. No. 3,520,681 and 483,675, filed Aug. 30, 1965. The inventive imaging members having the novel surface skin layers produce quality images having very low background.

Depending upon the specific imaging system used, including the specific imaging structure, materials, process steps, and other parameters, the advantageous imaging system of the present invention may produce positive images from positive originals.

Where the developed images migration imaging member comprises an image pattern of migrated marking material on the substrate, it has been found that the resultant image may, in some embodiments, be in a fragile and easily damageable condition. Such an unfixed migration image may be fixed to the substrate and thereby protected by a variety of methods and materials as disclosed, for example, in copending applications, Ser. No. 590,959, filed Oct. 29 1966, now abandoned and Ser. No. 695,214, filed Jan. 2, 1968, now abandoned. The imaged members resulting from the inventive process may be opaque or transparent copy suitable for use in almost any desired application for such imaged members.

The following examples further specifically define the present invention wherein migration imaging members having an advantageous surface skin layer are used in conjunction with migration imaging system. The parts and percentages are by weight unless otherwise indicated. The examples below are intended to illustrate various preferred embodiments of the novel migration imaging system.

EXAMPLE I

Imaging members or plates as illustrated in FIG. 1 are prepared. The softenable layer in this example comprises Piccotex 100, available from the Pennsylvania Industrial Chemical Company which is prepared as follows: about 1 mole of alpha-methyl styrene and about 1 mole of vinyl toluene are added to sufficient xylene to obtain an about 40 percent solution. A catalytic amount of BF etherate is added and the mixture is stirred until polymerization is complete. After polymerization, sufficient methanol is added to decompose any $BF_3$ remaining and then the Piccotex polymer is isolated by steam distillation. About 30 parts of Piccotex 100 is dissolved in about 100 parts isooctane. This solution is gravure coated onto an aluminized Mylar (polyethylene terephthalate available from E. I. duPont de Nemours & Co.) substrate to a dry thickness of about 2 microns. The coated sheet is divided into three portions. The first of these is untreated, the second is exposed to ultraviolet radiation from a Hanovia SH High Pressure Quartz Mercury Vapor Arc Lamp (available from the Hanovia Lamp Division of Englehard Industries) for about 12 minutes. The lamp is held about 5 inches from the sample. The third portion is exposed to the lamp at a distance of about 5 inches for about 18 minutes. A fracturable layer of selenium, approximately 0.2 micron in thickness is then deposited on each of the sheets by the inert gas deposition process described in copending application, Ser. No. 423,167, filed Jan. 4, 1965 now abandoned. Each plate is then electrostatically charged in darkness to a positive surface potential of about 120 volts by means of a corona discharge device, as described in Carlson U.S. Pat. No. 2,588,699. The plates are contact exposed through a conventional black-and-white transparency. Exposure is by means of a 4000 Angstrom lamp, $1\times10^{12}$ photons/cm$^2$/sec, for about 1 second. Each plate is then immersed in cyclohexane for about 3 seconds and removed. A fair image conforming to the original is observed on the plate which was not subjected to ultraviolet light. This plate, however, has high background and poor uniformity. An excellent image is obtained on the plate which was treated with ultraviolet light for 12 minutes. This plate has low background areas and excellent image uniformity. No image is obtained on the plate which was treated with ultraviolet light for 18 minutes. The thickness of the surface skin on a plate treated with ultraviolet light for about 12 minutes is measured by the method described in copending application Ser. No. 388,323 filed Aug. 7, 1964 now abandoned and found to be about 0.15 microns. The thickness of a skin formed by 18 minutes ultraviolet exposure is measured and found to be about 0.4 micron.

EXAMPLE II

A series of three imaging members or plates is prepared as in Example I except that the about 0.2 micron selenium layer is formed on the Piccotex 100 layer before treatment of the plate with ultraviolet light. Again, the about 12 minute exposure gives an excellent image while no exposure gives a poor image and about 18 minute exposure gives a very poor image. The thickness of the surface skin is measured and is found to be about 0.12 micron for an about 12 minute exposure and about 0.35 micron for an about 18 minute exposures.

EXAMPLE III

An imaging member or plate is prepared as in Example I. This plate is divided into three portions. Plate A is not treated, plate B is exposed to an ultraviolet light source as in Example I for about 12 minutes and plate C is exposed to the ultraviolet light for about 18 minutes. Finely powdered (about 10 micron average particle diameter) Monolite Fast Blue GS, a mixture of the alpha and beta crystal forms of metal-free phthalocyanine available from the Arnold Hoffman Company, is cascaded across the surface of the plate. A substantially uniform layer of the particles is deposited on the plate surface. The plates are then charged, exposed and developed as in Example I. Total exposure of each is about 200 ft. candle seconds. Each plate is then developed by immersion in cyclohexane for about 4 seconds. A fair image conforming to the original is observed on plate A. This plate, however, has poor background with excessive deposition of particles in background areas. An excellent image is observed on plate B. No image is obtained on plate C. Thus, as in Example I, an excellent image is formed on a plate having a surface skin of about 0.15 micron thickness. No image is formed where the skin has a thickness of about 0.4 micron.

EXAMPLE IV

About 60 parts Amoco 18, polyalphamethyl styrene available from the American Oil Company, is dissolved in about 200 parts toluene. This solution is flow-coated onto an aluminum sheet. The plate is dried for about 1 hour at about 70° C. The layer has a dry thickness of about 2 microns. The plate is divided into three portions and treated as follows: plate A is not treated, plate B is exposed for about 20 minutes to a Hanovia ultraviolet lamp spaced about 5 inches from the plate and plate C is exposed for about 2 hours to the Hanovia lamp about 5 inches from the plate. These plates are coated with a layer of selenium as in Example I. The plates are then each charged, exposed and developed as in Example I. An image of poor quality is observed on plate A. Plate B shows an image of excellent quality with substantially no particle deposition in background areas. No image is observed on plate C. The thickness of the surface skin on each plate is measured. Plate A has no surface skin, plate B has a skin of about 0.15 micron thickness and plate C has a surface skin of about 0.4 micron thickness.

EXAMPLE V

An imaging member or plate is prepared as in Example I. This plate is divided into two parts, part A is not treated and part B is subjected to continuous corona charging by means of a corona head maintained at about 7000 volts for about 12 hours. These plates are coated with selenium, charged, exposed and developed as in Example I above. Plate A shows a fair image with some background. Plate B shows a much-improved image with less background. This example illustrates that a surface skin is formed by extended corona charging instead of the ultraviolet light treatment.

EXAMPLE VI

A 3 micron layer of a styrene-methyl styrene copolymer is formed on an aluminum substrate. This layer is formed as follows: about 1 mole of alpha-methyl styrene and about 1 mole of styrene are added to sufficient xylene to obtain an about 40 percent solution. A catalytic amount of $BF_3$ etherate is added and the mixture is stirred until polymerization is complete. After polymerization, sufficient methanol is added to decompose any $BF_3$, remaining and the copolymer is isolated by steam distillation. About 30 parts of the copolymer is dissolved in about 100 parts toluene. The aluminum substrate is flow coated with this solution. This layer is coated with selenium as in Example I. The plate is then divided into three portions and treated as follows: plate A is not treated, plate B is exposed for about 15 minutes to ultraviolet light by means of a Hanovia lamp spaced about 5 inches from the plate and plate C is similarly exposed for about 75 minutes. Each plate is then charged to a negative potential of about 300 volts. Each plate is then exposed and developed as in Example I. A good image is observed on plate A. Plate B has a significantly better image with greater uniformity. A poor image with high background and poor image uniformity is observed on plate C. The surface skin on plate B is measured and found to be about 0.1 micron. The surface skin on plate C is measured and found to be about 0.4 micron.

EXAMPLE VII

A 4 micron layer of polydiphenyl siloxane is formed on the conductive surface of an aluminized Mylar sheet. The layer is formed as follows: about 600 parts of octaphenyl-cyclotetrasiloxane is placed in a flask under nitrogen and heated to about 230° C. about one part cesium hydroxide is added and, while stirring, the temperature is slowly increased to about 260° C. and is maintained there for about 1 hour. About 0.5 parts additional cesium hydroxide is then added and the solution is maintained at about 260° C. for about an additional 1½ hours. At this time iodine is added until the purple color disappears, indicating that the remaining cesium hydroxide has been neutralized. Excess iodine is allowed to subline and the mixture is cooled to about 125° C. About 430 parts toluene is then added and stirred into the now-viscous mixture. The mixture is allowed to stand for about 72 hours and the crystalline material that forms is filtered off. Residual solvent is then removed from the polymer by distillation at atmospheric pressure, followed by vacuum evaporation at about 125° C. This yields a polymer which melts to a liquid at about 80° C. About 30 parts of this polymer is dissolved in about 100 parts toluene and the solution is coated onto the aluminum substrate and dried.

This plate is divided into three portions and treated as follows: plate A is not treated, plate B is exposed for about 20 minutes to ultraviolet light by means of a Hanovia lamp about 5 inches from the plate and plate C is similarly exposed for about 110 minutes. A fracturable layer of Monolite Fast Blue GS is then formed by cascade. The plates are then each charged to a potential of about 350 volts. Each plate is then exposed and developed as in Example I. Plate A which has no surface skin exhibits a good image. Plate B which is found to have a skin thickness of about 0.2 micron has an excellent image. Plate C which has a surface skin of about 0.5 micron has no image.

EXAMPLE VIII

About a 4 micron layer of Piccotex 100 is formed on an aluminum substrate. This plate is divided into four portions which are treated as follows: plate A is untreated, plate B is solution dip coated with about a 0.06 micron layer of Butvar B-76, a polyvinyl butyral resin available from the Monsanto Chemical Company having a molecular weight of about 50,000, plate C is solution dip coated with about a 0.1 micron layer of Butvar B-76 and plate D is solution dip coated with about a 0.5 micron layer of Butvar B-76. Each of these plates is coated with a fracturable layer of selenium as in Example I above. The plates then are each charged to a negative potential of about 280 volts. The plates are then each exposed and developed as in Example I above. Plate A which has no surface skin exhibits a fair image with high background. Plate B and plate C each have an excellent image while plate D has no image.

EXAMPLE IX

A layer of Piccotex 100 about 4 microns thick is formed on the conductive surface of an aluminized Mylar sheet. This plate is divided into three portions. These three plates are then treated as follows: plate A is not treated, plate B is solution dip coated with about a 0.1 micron layer of Gelvatol 3–60, a polyvinyl alcohol resin available from Shawinigan Products Inc. having a molecular weight of about 90,000 and plate C is solution dip coated with about a 0.5 micron layer of Gelvatol 3–60. Each portion of the plate is coated with a fracturable layer of finely divided Monolite Fast Blue GS. Each plate is then charged to a negative potential of about 200 volts. Each plate is then exposed and developed as in Example I above. A fair image is observed on plate A. Plate B shows an image of excellent quality. No image is observed on plate C.

EXAMPLE X

A layer of Piccotex 100 about 4 microns thick is formed on an aluminum substrate. This sheet is divided into four portions. These plates are treated as follows: plate A is untreated, plate B is solution dip coated with about a 0.01 micron layer of Bakelite CKR-2400, a phenol formaldehyde resin available from the Union Carbide Chemical Company, plate C is solution dip coated with about a 0.08 micron layer of Bakelite CKR-2400 and plate D is solution dip coated with about a 0.5 micron layer of Bakelite CKR-2400. Each of these plates is coated with a fracturable layer of selenium as in Example I above and is charged to a negative potential of about 250 volts. Each plate is then exposed and developed as in Example I above. Plate A shows a good image. Plates B and C exhibit excellent images. No image is observed on plate D.

EXAMPLE XI

A layer of Piccotex 100 is formed on aluminum substrate to a thickness of about 4 microns. This sheet is divided into three portions. These plates are treated as follows: plate A is untreated, plate B is spray coated with Krylon, an acrylic ester sold by Krylon, Inc. in aerosol form, to a thickness of about 0.15 micron and plate C is spray coated with Krylon to a thickness of about 0.7 micron. Each of these plates is over-coated with selenium as in Example I above and charged to a positive potential of about 50 volts. Each plate is then exposed and developed as in Example I above. A fair image is observed on plate A. Plate B exhibits an excellent image of very low background. No image is observed on plate C.

EXAMPLE XII

About 60 parts Amoco 18 is dissolved in about 200 parts toluene. This solution is flow coated onto aluminized Mylar to a dry film thickness of about 2 microns. The resin surface is coated with about a 0.2 micron fracturable layer of selenium, as described in Example I. The sheet is then divided into two portions. One portion is exposed to an ultraviolet radiation source as in Example IV. Each portion is charged and exposed as in Example I. A beaker is about half filled with chloroform. Vapor above the liquid surface is allowed to come to equilibrium at room temperature. Each portion is then held in the vapor for about 2 seconds to develop the electrostatic latent images. Images may be observed during development through the wall of the beaker. The untreated portion is observed to bear an image which is a negative of the original contrast density is low; about 0.2. The treated portion, which contains a surface skin, is observed to bear an image which is a positive copy of the original. Contrast density is much higher; about 0.7.

EXAMPLE XIII

About 50 parts Piccopale H-2, a highly branched polyolefin available from Pennsylvania Industrial Chemical Corporation, is dissolved in about 100 parts cyclohexane. This solution is spray coated onto an aluminized Mylar sheet to a dry thickness of about 2 microns. The sheet is then divided into two portions. One portion is exposed to a Hanovia ultraviolet lamp spaced about 5 inches from the sheet for about 20 minutes. Each portion is then overcoated with about a 0.2 micron fracturable layer of selenium as described in Example I. Each portion is charged and exposed as in Example I. A beaker is half filled with toluene. Vapor above the liquid surface is allowed to come to equilibrium at room temperature. The two portions are placed in the vapor for about 2 seconds. The untreated portion has an image which is a negative of the original. Contrast density is about 0.3. The treated portion, which has a surface skin, has an image which is a positive reproduction of the original. Contrast density is much improved; about 0.8.

EXAMPLE XIV

About 12 parts Piccotex 100 is dissolved in about 25 parts toluene. To this solution is added about two parts Bakelite 2432, a phenyl formaldehyde resin available from the Union Carbide Corporation. This solution is then dip coated onto an aluminum sheet to a dry film thickness of about 15 microns. As further discussed in copending application Ser. No. 559,331 filed June 21, 1966, now abandoned it appears that the Bakelite 2432 migrates to the surface of the film, forming in effect a skin of higher viscosity material. The plate is overcoated with about a 0.2 micron fracturable layer of selenium. The plate is next charged, exposed and developed as in Example I. An image of excellent quality is produced on the plate.

EXAMPLE XV

An imaging member having a binder layer of softenable material wherein the migration marking material is dispersed is prepared using Piccotex 100 as the softenable material layer as described in Example I. The migration marking material is *x*-form phthalocyanine prepared by neat milling commercially prepared alpha metal-free phthalocyanine for about 48 hours by milling about 40 grams of the commercial phthalocyanine with about 1500 grams of 13/16 inch burundum cylinders in a size 00 Roalax jar on a roller mill turning at about 72 r.p.m. After about 100 ml of methanol added to the jar, the slurry is filtered and washed in more methanol and then dried.

The binder coating solution is then prepared by combining about 3–5 parts of the *x*-form phthalocyanine with a solution of about 30 parts of Piccotex 100 in about 100 parts of isooctane. This solution is well mixed and gravure coated onto an about 3 mil aluminized Mylar (polyethylene terethylate available from E. I. duPont De Nemours and Co.) substrate to a dried thickness of about 4 microns. The imaging member is then exposed to ultra violet radiation from a Hanovia SH High Pressure Quartz Mercury Vapor Arc Lamp for a few minutes. The imaging member is then electrostatically charged in darkness to a positive surface potential of about 2000 volts, and contact exposed through a black-and-white photographic transparency with about 0.3 f.c.s. (foot-candle-seconds) of illumination from a tungsten lamp operating at about 3400° K. This latently imaged member is then developed by exposing it to trichloroethylene vapors for a few seconds. A migration image wherein the particles in the unexposed areas migrate toward the substrate is obtained.

EXAMPLE XVI

A binder layer migration imaging member as described in Example XV is prepared and coated with Krylon as described in Example XI. The plate is then charged, exposed and developed as described in Example XV, producing a migration image. In the novel migration imaging system wherein migration imaging members having an advantageous surface skin layer are used, other suitable materials and variations in the various steps in the system as listed herein may be used with satisfactory results and various degrees of quality. In addition, other materials and steps may be added to those used herein and variations may be made in the process to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principle and scope of this invention.

What is claimed is:

1. An imaging method comprising:

providing an imaging member comprising a supporting substrate, a layer of softenable material containing migration marking material overlying said substrate, said softenable material capable of having its resistance to migration of migration marking material decreased sufficiently to allow migration of migration marking material in depth in said softenable material toward said substrate, a surface skin located at the entire free surface area of said softenable layer formed by exposing said free surface to hardening radiation sufficiently to form said surface skin having a thickness in the range of not greater than about 0.3 micron and having a viscosity during imaging of said member greater than the viscosity of the softenable material of said softenable layer;

applying an electrical imagewise migration force to the migration marking material;

developing said member by decreasing the resistance to migration of migration marking material in depth in the softenable material at least sufficient to allow migration of migration material whereby migration marking material migrates at least in depth in said softenable material toward the substrate in imagewise configuration.

2. The method of claim 1 wherein the imagewise migration force is provided by providing an electrical latent image on the imaging member.

3. The method of claim 1 wherein said hardening radiation is ultraviolet radiation.

4. The method of claim 1 wherein said softenable layer is softened by heating the imaging member.

5. The method of claim 1 wherein said softenable layer is softened by exposing the imaging member to vapors comprising vapors of a solvent for said softenable material.

6. The method of claim 1 wherein the softenable layer is softened by the application of a liquid solvent for the softenable material.

7. The method of claim 1 wherein the softenable layer is softened and non-image forming portions of the migration marking material and residual portions of the softenable material are washed away by the application of a liquid solvent for said softenable layer.

8. The method of claim 1 wherein said softenable material is a mixture of polystyrene and acrylic polymers.

9. An imaging method comprising:

providing an imaging member comprising a supporting substrate a single layer of softenable material containing migration marking material overlying said substrate, said softenable material containing as the entire upper portion thereof a surface skin having a chemical composition different from the bulk of the softenable material and having a thickness not greater than about 0.3 micron and a viscosity during imaging of said member greater than that of the bulk of said softenable layer of softenable material, said softenable material capable of having its resistance to migration of migration marking material dispersed sufficiently to allow migration of migration marking material in depth in said softenable material toward said substrate;

applying an electrical imagewise migration force to the migration marking material, developing said member by decreasing the resistance of migration of migration marking material in depth in the softenable material at least sufficient to allow migration of migration material whereby migration marking material migrates at least in depth in said softenable material toward the substrate in imagewise configuration.

10. The method of claim 9 wherein the imagewise migration force is provided by providing an electrical latent image on the imaging member.

11. The method of claim 9 wherein said softenable layer is softened by heating the imaging member.

12. The method of claim 9 wherein said softenable layer is softened by exposing the imaging member to vapors comprising vapors of a solvent for said softenable material.

13. The method of claim 9 wherein the softenable layer is softened by the application of a liquid solvent for the softenable material.

14. The method of claim 9 wherein the softenable layer is softened and non-image forming portions of the migration marking material and residual portions of the softenable material are washed away by the application of a liquid solvent for said softenable layer.

15. The method of claim 9 wherein said surface skin is a phenol formaldehyde resin.

16. The method of claim 15 wherein said softenable material is a mixture of polystyrene and acrylic polymers.

17. The method of claim 16 wherein said phenol formaldehyde resin is selected from the group consisting of p-tertary-butyl phenol formaldehyde resin and p-phenyl phenol formaldehyde resin and said softenable layer is a mixture of styrene and hexylmethacrylate.

* * * * *